United States Patent [19]

Field, Jr.

[11] Patent Number: 4,487,106

[45] Date of Patent: Dec. 11, 1984

[54] FLUID OPERATED SYSTEM

[75] Inventor: Jesse L. Field, Jr., Mentor, Ohio

[73] Assignee: Towmotor Corporation, Mentor, Ohio

[21] Appl. No.: 548,736

[22] Filed: Nov. 4, 1983

[51] Int. Cl.[3] ..... F15B 13/06

[52] U.S. Cl. ..... 91/436; 91/427; 91/437; 91/445; 91/450; 91/461; 91/526; 91/527

[58] Field of Search ..... 91/427, 436, 437, 445, 91/451, 468, 450, 461, 449, 442, 526, 527

[56] References Cited

U.S. PATENT DOCUMENTS

| | | | |
|---|---|---|---|
| 2,944,524 | 7/1960 | Brandstadter et al. | 91/445 |
| 3,194,261 | 7/1965 | Tennis | 91/437 |
| 3,620,129 | 11/1971 | Fruehauf | 91/449 |
| 3,795,110 | 3/1974 | Kobelt | 91/427 |
| 3,893,572 | 7/1975 | Axelsson et al. | 212/49 |
| 3,960,059 | 6/1976 | Schexnayder | 91/450 |
| 4,228,818 | 10/1980 | Nelson | 91/437 |
| 4,313,633 | 2/1982 | Muntjanoff et al. | 91/450 |
| 4,358,242 | 11/1982 | Davies | 91/445 |

FOREIGN PATENT DOCUMENTS

| | | | |
|---|---|---|---|
| 2413385 | 10/1975 | Fed. Rep. of Germany | 91/450 |

*Primary Examiner*—Robert E. Garrett
*Assistant Examiner*—Richard S. Meyer
*Attorney, Agent, or Firm*—Alan J. Hickman

[57] ABSTRACT

Fluid control systems frequently eliminate use of fluid operated jack protecting relief valves because additional visibility blocking and damage prone conduits are required to connect the relief valves to the reservoir. A fluid operated system having a controlling valve, a selecting valve, a fluid operated jack, a relief valve, a reservoir and a bypass valve is provided to controllably connect the relief valve to other portions of the system in response to the position of controlling valve and selecting valve. Therefore, no additional conduits are required to connect the relief valve to the reservoir and thus the problems of reduced visibility, premature conduit leakage and conduit damage are eliminated. The fluid control system is particularly suited for use in a work vehicle such as a lift truck having a lift mast.

18 Claims, 2 Drawing Figures

FLUID OPERATED SYSTEM

DESCRIPTION

TECHNICAL FIELD

This invention relates generally to a fluid control system having a fluid pressure relieving arrangement and more particularly to a fluid control system having a relief valve, a reservoir, a controlling valve, a selecting valve and a bypass valve to connect the relief valve to other portions of the system in response to the positions of the controlling valve and the selecting valve.

BACKGROUND ART

Relief valves and the like have been employed in fluid operated systems to protect fluid operated motors and associated system componentry from excessive fluid pressure which is detrimental to the life of the motors and componentry. Typically the relief valves are connected to the system reservoir either directly or through a controlling valve of the system. In either situation a continuously open passageway between the relief valve and reservoir must be provided so that fluid flow from the relief valve to the reservoir may be freely passed.

Often the fluid operated system is utilized to controllably power an implement; such as provided on a lift truck or earthmover. In these applications, the use of a separate conduit to directly connect the relief valve to the reservoir is undesirable because, it reduces visibility past the implement, is subject to damage, and requires additional parts which adds to the cost and complexity of the vehicle.

In implements having a plurality of different functions, several fluid operated motors are normally provided. For example, a container handling attachment of a lift truck requires side shift, slew, extend, reach, and leveling functions. In such applications the jacks associated with each function must have the capability of being individually controlled. It has been found that the number of conduits connecting the conrolling valve to the jacks can be reduced to two when a selecting valve for each function is provided. The selecting valves are mounted on the implement and a single controlling valve for modulating fluid flow is mounted on the vehicle. The pair of conduits connect the controlling valve to the selecting valve and provide flow paths from a pump to the jack and from the motor to the reservoir. In this embodiment the selecting valves block flow between the controlling valve and the respective motors and thus isolate the jacks from the reservoir. Locating the relief valves between the selecting valves and the controlling valve prevents communication of the relief valves with the jacks, and locating the relief valves between the jacks and selecting valves isolates the relief valves from the reservoir. Providing a separate conduit to connect each relief valve to the reservoir is not a viable solution for substantially the same reasons as discussed above.

The present invention is directed to overcoming one or more of the problems as set forth above.

DISCLOSURE OF THE INVENTION

In one aspect of the invention, a fluid controlling system having a reservoir, a pump connected to the reservoir and a fluid operated motor connected to the pump is provided. The fluid operated jack is adopted to deliver a first signal in response to a pressure within the motor being greater than a preselected magnitude. A controlling valve having a first passageway is connected to and between the reservoir and the motor and movable between a first position at which the first passageway is blocked and a second position at which the first passageway is open to the reservoir and the jack. A selecting valve having a third passageway is connected between the controlling valve and the jack and movable between a first position at which the third passageway is blocked and a second position at which the third passageway is open to the controlling valve and the jack. A first relief valve is connected to and between the motor and the controlling valve and in parallel with the selecting valve. The first relief valve is movable in response to receiving the first signal from a first position at which a passageway thereof is blocked and a second position at which the passageway is open to the motor and the controlling valve. A bypass valve is connected to and between the selecting valve and the reservoir and in parallel with the controlling valve. The bypass valve is movable from a first position at which a passageway thereof is open to the selecting valve and the reservoir, and to a second position at which the passageway is blocked in response to movement of the controlling valve from the first position to the second position.

Because the relief valve is connected in parallel with the selecting valve and the bypass valve is connected in parallel with the controlling valve no additional conduits are required to pass fluid flow between the selector and controlling valves.

Since, the bypass is movable from the first position to the second position in response to movement of the controlling valve from the first position to the second position a path from the relief valve to the reservoir will always be open.

Finally, since the relief valve is connected in parallel with the selecting valve, fluid flow is passible by the relief valve between the rod and head ends of the motor when the selecting valve is at the second position.

BEST MODE FOR CARRYING OUT THE INVENTION

Figure 1:
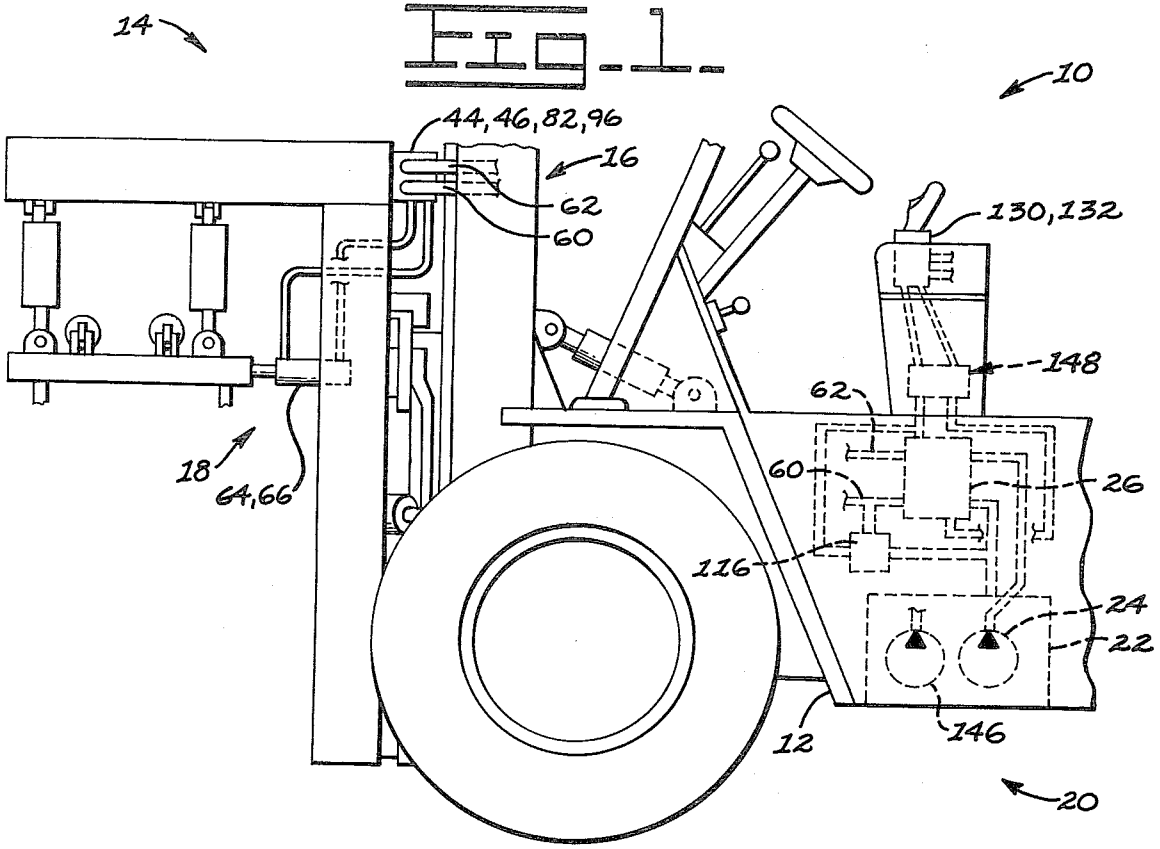
FIG. 1 is a diagrammatic partial side elevational view of an embodiment of the present invention showing a view of a lift truck having a container handling attachment mounted thereon and showing the location of the various components of the fluid operated system.
Figure 2:
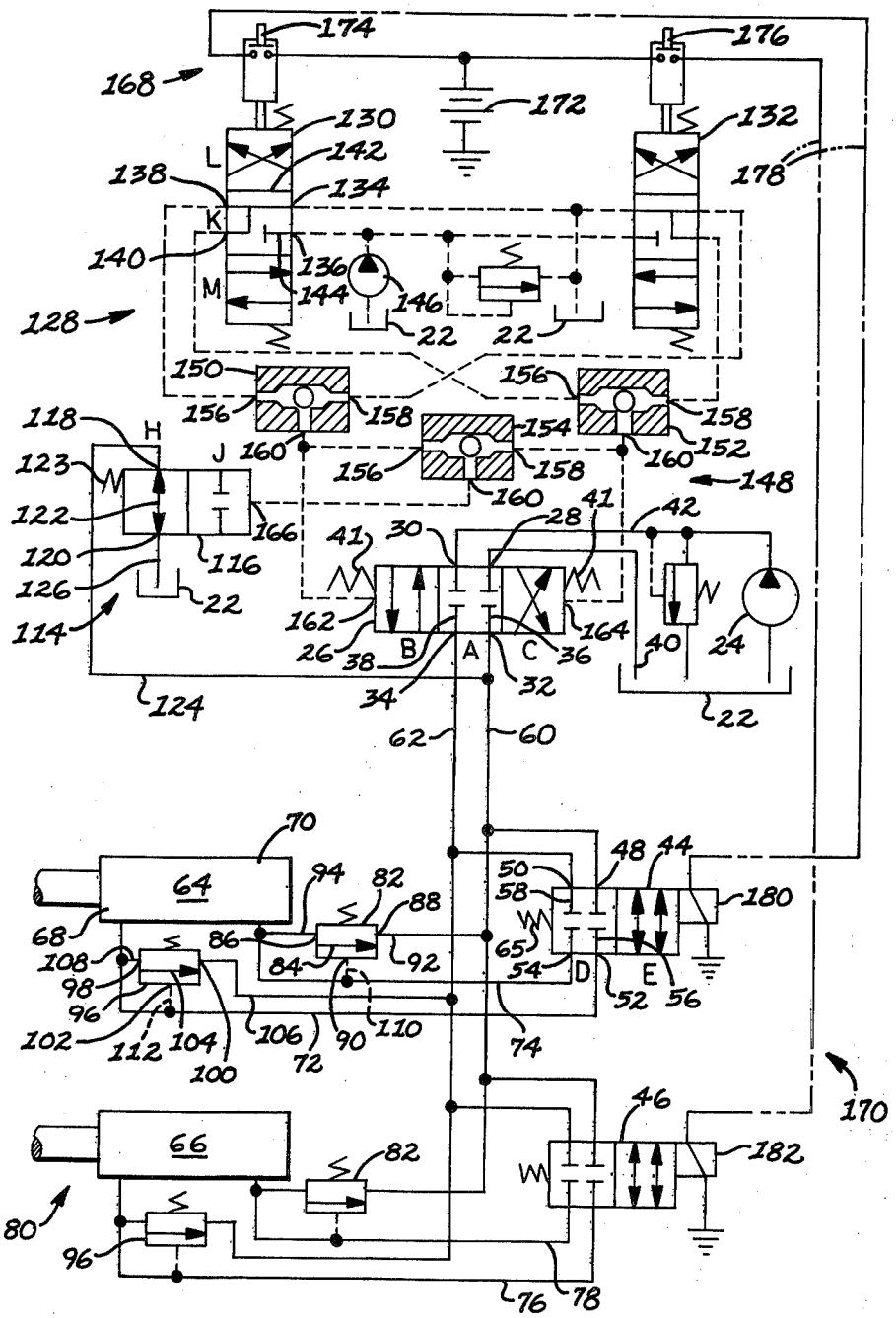
FIG. 2 is a diagrammatic schematic representation of the fluid operated system of FIG. 1 showing the components thereof and their connections relative to each other.

With reference to the drawings, a work vehicle 10, for example, a lift truck, earthmover and the like, has a frame 12 and a work implement 14, for example, a load lifting device, mounted on the frame 12. The work implement 14 is preferably a lift mast 16 having a container handling attachment 18 mounted thereon. However, other work implements such as, buckets, boom mounted devices, and the like are to be considered equivalents.

A fluid operated system 20, preferably of the type suitable for controllably powering the work implement 14, is mounted on the work vehicle 10. The fluid operated system has a reservoir 22 mounted on the frame 12 and an implement pump 24 mounted on the frame 12 and connected to the reservoir 22.

A controlling valve 26 having first and second inlets 28 and 30, first and second outlets 32 and 34, and first and second passageways 36 and 38, is mounted on the frame 12. A conduit 40 connects the reservoir 22 to the first inlet 28 and a conduit 42 connects the pump 24 to the second inlet 30. The controlling valve 26 is movable between a first position "A" at which the first and second passageways 36 and 38 are blocked, a second position "B" at which the first passageway 36 is open to the first inlet 28 and first outlet 32 and the second passageway 38 is open to the second inlet 30 and second outlet 34, and a third position "C" at which the first passageway 36 is open to the first inlet 28 and second outlet 34 and the second passageway 34 is open to the second inlet 30 and first outlet 32. The controlling valve 26 has a pair of centering springs 41 which normally biases the valve 26 to position "A".

A first selecting valve 44 and second selecting valve 46 are mounted on the work implement 14. Because the selecting valves 44,46 are identical in construction and movement, they will not be discussed separately. The selecting valves 44 and 46 each have first and second inlets 48 and 50, first and second outlets 52 and 54, and first and second passageways 56 and 58. A first conduit 60 connects the first outlet 32 of controlling valve 26 to the first inlet 48 of the selecting valve 44, and a second conduit 62 connects the second outlet 34 of the controlling valve 26 to the second inlet 50 of the selecting valve 44. The selecting valve 44 and 46 are movable between a first position "D" at which the first and second passageways 56 and 58 thereof are blocked, and a second position "E" at which the first passageway 56 thereof is open to the first inlet 48 and first outlet 52, and the second passageway 58 thereof is open to the second inlet 50 and second outlet 54. It is to be noed that the first and second conduits have branch conduits which connect the selecting valves in parallel. Thus, each selecting valve 44,46 has access to the controlling valve 26 at all times. Also, the conduits 62 and 64 are the only fluid carrying conduits which pass fluid between the frame 12 and implement 14. Each of the selecting valves 44 and 46 have a spring 65 which biases the selecting valves 44 and 46 toward the first position "D".

First and seconds jacks 64 and 66 are provided to power the various movements of the work implement 14. The first and second jacks 64,66 each have a rod end 68 and a head end 70, and are mounted on the work implement 14. The rod end 68 of the first jack 64 is connected to the first outlet 52 of the first selecting valve 44 by a third conduit 72 and the head end 68 of the first jack 64 is connected to the second outlet 54 of the first selecting valve by a fourth conduit 74. Similarly, the rod end 68 of the second jack 66 is connected to the first outlet 52 of the second selecting valve 46 via a fifth conduit 76 and the head end 70 of the second jack 66 is connected to the second outlet 54 of the second selecting valve 46 via a sixth conduit 78.

Each of the jacks 44,46 are adapted to deliver a signal in response to an associated pressure within the respective jack being greater than a preselected magnitude. Specifically, each jack is adapted to deliver a first signal "F" in response to a fluid pressure within the head end 70 being greater than a preselected magnitude, and a second signal "G" in response to a fluid pressure within the rod end 68 being greater than a preselected magnitude.

A first means 80 is provided for receiving the delivered signal and passing fluid flow from one of the rod and head ends 68 and 70 of one of the jacks 64,66 through the first 56 and second 58 passageways of the selecting valves (44,46) to the other of the rod and head ends of the same jack 64,66 only when the associated one of the first and second selecting valves 44 and 46 is at the second position "E".

The first means 80 preferably includes a first relief valve 82 having a passageway 84, an inlet 86, an outlet 88 and a signal port 90. The outlet 88 is connected to the first conduit 60 via conduit 92 and the inlet 86 is connected to the head end 70 via conduit 94. The first means also includes a second relief valve 96 having an inlet 98, an outlet 100, a signal port 102 and a passageway 104. The outlet 100 is connected to the second conduit 62 via conduit 106 and the inlet 98 is connected to the rod end 68 via a conduit 108. Each of the first and second relief valves 82 and 96 are independently movable between a first position at which the respective passageways 84,104 are blocked, and a second position at which the passageway 84 of the first relief valve is open to the inlet 98 and outlet 100. It is to be noted that each of the first and second jacks 64 and 66 have first and second relief valves 82,96, as heretofore discussed, associated therewith.

The head ends 70 of the first and second jacks 64 and 66 are connected to the signal ports 90 of the first relief valves, respectively via conduits 110, and the rod ends 68 of the first and second jacks 64 and 66 are connected to the signal ports 102 of the second relief valves 96, respectively, via conduits 112. Therefore, the first signal "F" is passed by the conduits 110 to the first relief valves 82 and the conduit 112 passes the second signal "G" to the second relief valves 96. Each of the relief valves 82 and 96 are movable from the first position to the second position in response to receiving their respective signals "F" and "G".

A second means 114 is provided for passing fluid flow passed by the first means 80 from one of the rod and head ends 68 and 70 to the reservoir 22 in response to the control valve 26 and the selector valves 44 and 46 being at their first position "A" and "D", respectively. The second means 114 preferably includes a bypass valve 116 having an inlet 118, an outlet 120 and a passageway 122 operatively associated with the inlet 118 and outlet 120. The inlet 118 is connected to the first outlet 32 of the controlling valve 26 by conduit 124 and the outlet 120 is connected to the reservoir 22 by conduit 126. The bypass valve 116 is movable between a first position "H" at which the passageway 122 is open to the inlet 118 and outlet 120 and a second position "J" at which the passageway 122 is blocked. The bypass valve passes fluid flow passed by first conduit 60 to the reservoir when at the first position "H". It should be noted that a spring 123 normally biases the bypass valve to the first position "H".

A pilot system 128 includes a first pilot valve 130 and a second pilot valve 132 both mounted on the frame 12 of the vehicle 10 and both identical in construction. The first and second pilot valves 130 and 132 each have a pair of inlets 134 and 136, a pair of outlets 138 and 140, and a pair of passageways 142 and 144. The pilot valves 130 and 132 are each selectively manually movable between a first position "K" at which passageway 142 is open to the inlet 134 and outlets 138 and 140, and passageway 144 is blocked, a second position "L" at which passageway 142 is open to inlet 134 and outlet 140 and passageway 144 is open to inlet 136 and outlet 138, and a third position "M" at which passageway 144 is open to inlet 136 and outlet 140 and passageway 142 is open to inlet 134 and outlet 138. Inlets 136 are connected to a pilot pump 146, inlets 134 are connected to the reservoir 22 and the outlets 138 and 140 are connected to a shuttle valve arrangement 148.

The shuttle valve arrangement 148 has a first, second and third 150, 152 and 154 shuttle valves each having a first and second inlets 156 and 158 and an outlet 160. Outlet 138 of the first pilot valve 130 is connected to the inlet 156 of the first shuttle valve 150, outlet 138 of the second pilot valve 132 is connected to inlet 158 of the first shuttle valve 150, and outlet 160 of the first shuttle valve is connected to a first pilot port 162 of the controlling valve 26. Similarly, outlet 140 of the first pilot valve 130 is connected to inlet 156 of the second shuttle valve 152, outlet 140 of the second pilot valve 132 is connected to the inlet 158 of the second shuttle valve 152, and outlet 160 of the second shuttle valve 152 is connected to a second pilot port 164 of the controlling valve 26. The outlet 160 of the first shuttle valve is also connected to inlet 156 of the third shuttle valve 154, the outlet 160 of the second shuttle valve 152 is also connected to the inlet 158 of the third shuttle valve 154, and the outlet 160 of the third shuttle valve is connected to the pilot port 166 of the bypass valve 116.

The first and second shuttle valves 150,152 are provided to block pilot fluid flow from passing between the pilot valves 130 and 132 and direct pilot fluid flow, at the highest pressure, to the pilot ports 162 and 164 as inferred by the heretofore discussed connections. The third shuttle valve 154 blocks pilot fluid flow from passing between the outlets 160 of the first and second shuttle valves and directs the pilot fluid flow at the greatest pressure to the pilot port 166 of the bypass valve 116.

It is to be noted that pilot system 114 may be replaced by an electrical equivalent without departing from the spirit of the invention.

A means 168 for delivering a control signal to the selecting valves 44 and 46, and a means 170 for receiving the delivered control signal and moving the selecting valves 44 and 46 from the first position "D" to the second position "E" is provided. Specifically, means 168 includes a source of electrical power 172, first and second switches 174 and 176 and connecting circuitry 178. Means 170 includes first and second solenoids 180 and 182 connected to the first and second selecting valves 44 and 46, respectively. The connecting circuitry 178 connects the first switch 174 to the first solenoid 180 and the second switch 176 to the second solenoid 182. Each switch 174 and 176 is movable between the first position at which electrical current is blocked from passing from the source to its respective solenoid 180,182 and a second position at which electrical current is passed from the source to its respective solenoid 180,182. The first solenoid 180 is adapted to move the first selecting valve 44 to the second position "E" at the second position of the first switch 174, and the second solenoid 182 is adapted to move the second selecting valve 46 to the second position "E" at the second position of the second switch 176. It should be noted that means 166 and 168 may be substituted by equivalent mechanical or hydraulic devices without departing from the spirit of the invention.

INDUSTRIAL APPLICABILITY

In operation and with reference to the drawings, the operator of the vehicle 10 actuates a desired one of the first and second pilot valves 130 and 132 by manually shifting one of the pilot valves 130,132 to position "L" or "M" to position the work implement 14. Assuming that the operator desires to extend jack 64 he would shift selecting valve 130 to second position "L" and depress switch 174 to connect the source 172 to the first solenoid 180. Because the pilot valves 130 and 132 are capable of modulating fluid pressure delivered from the pilot pump to the controlling valve 26 and thereby control the amount of movement of the controlling valve 26 the speed of extension or retraction of the jacks 64 and 66 may be accurately controlled.

At the first position "L" of pilot valve 130, flow from pilot pump 146 is passed through passageway 144 from inlet 136 to outlet 138 and to inlet 156 of first shuttle valve 150 which causes the first shuttle valve 150 to block inlet 158 from outlet 160 and pass the fluid flow from inlet 156 through outlet 160 to the first pilot port 162 of selecting valve 26. The pressure of the fluid at the first pilot port 162 acts on the controlling valve 26 and moves the controlling valve toward second position "B". At the same time a portion of the pilot flow passed by outlet 160 of the first shuttle valve 150 is directed to the inlet 156 of the third shuttle valve 154. The third shuttle valve 154 responds to this pilot fluid flow by blocking the second inlet 158 from the first inlet 156 and outlet 160, and passes the pilot fluid flow through outlet 160 to the pilot port 166 of bypass valve 116. The bypass valve 116, as a result of the pilot fluid pressure acting thereon, moves to the second position "J".

With the controlling valve in position "B", fluid flow from implement pump 24 is directed by the second passageway 38 of the controlling valve 26 from the first inlet 30 to the first outlet 34 and to the second inlet 50 of the first and second selecting valves 44 and 46. This is achieved because the selecting valves 44,46 are in parallel with each other relative to the controlling valve 26.

With the first switch 174 in the depressed or closed position electrical current is passed to the first solenoid 180. The first solenoid 180 responds to this electrical current by moving the first selecting valve 44 to the second position "E". At second position "E", implement pump flow at the second inlet 50 of the first selecting valve 44 is passed by passageway 58 to the second outlet 54 of the first selecting valve 44 and through conduit 74 to the head end 70 of first jack 64.

Fluid flow from the rod end 68 of the first jack 68 is exhausted therefrom through conduit 72, past outlet 52 of the first selecting valve 44, through the third passageway 56, past inlet 48, through conduit 60 and to outlet 32 of controlling valve 26. Because the first passageway 36 is open to the first inlet 28 and the first outlet 32 and rod end flow is directed therethrough to reservoir 22.

It is noted that when the first selecting valve 44 is at the second position "E" the first and second relief valves 82 and 96 associated with the first jack 64 are connected through the first and second passageways 56 and 58 of the first selecting valve 44 to the rod and head ends 68 and 70 of the first jack 64. Therefore, the first relief valve 82 will pass fluid flow from the head end 70 of the first jack 64 through the first selecting valve 44 to the rod end 68 of the first jack 64 whenever the pressure in the head end 70 is greater than the preselected magnitude and the pressure in the rod end 68 is less than reservoir pressure or a negative pressure, and the second relief valve 96 will pass fluid flow from the rod end 68 of the first jack 64 through the first selecting valve 44 to the head end 70 of the first jack whenever the pressure in the rod end 68 is greater than the preselected magnitude and the pressure in the head end 70 is less than reservoir pressure or a negative pressure.

In the instant situation the controlling valve first passage 36 is open to the reservoir 22 and the bypass valve passage 122 is blocked to the reservoir 22. Therefore, return flow from the rod end 68 of the jack 64 must pass through the first passageway 36 to the reservoir 22.

Because the bypass valve 116 is at the first position "H" when the controlling valve 26 is at the first position "A" and at the second position "J" when the controlling valve 26 is at either of the second "B" or third "C" positions a path for fluid flow from the outlet 88 of the first relief valves 82 is always available. At position "C" the relief fluid flow will combine with flow from pump 24, and in positions "A" and "B". the relief fluid flow will be directed to the reservoir, by bypass valve 116 and controlling valve 26, respectively. Also, because the bypass valve 116 blocks flow from the first outlet 32 to the reservoir 22 in response to the controlling valve 26 being at the third position "C" pressurized fluid flow is passable by conduit 60 to the jacks 64 and 66 to move the jacks.

To retract first jack 64, first pilot valve 130 must be shifted to the third position "M" and first switch 174 must be depressed. At position "M" pilot pump flow is directed by the shuttle valve arrangement 148 to pilot ports 164 and 166 which moves the controlling valve 26 to third position "C" and the bypass valve 116 to blocking position "J". Thus implement pump flow is directed by second passageway 38 from inlet 30 to outlet 32, through conduit 60, through third passageway 56, and conduit 72 to the head end of the jack 64. Return fluid flow from the head end 64 of the first jack 70 is passed by the second passageway 58 and first passageway 36 to reservoir 22.

Because of the interaction between the controlling valve 26 and bypass valve 116, because the bypass valve 116 is connected to the controlling valve 26 at outlet 32 on the vehicle frame 12, and because the selecting valves 44 and 46 are provided on the implement 14 only two conduits 60 and 62 are required to carry fluid flow between the controlling valve 26 and the selecting valves 44 and 46 while providing a continuously open passageway between the first relief valve 82 and the reservoir.

Operation of the second jack 66 is achieved through actuation of the second pilot valve 132 and second switch 176 in a manner similar to that of the first pilot valve 130 and first switch 174 and may be understood through a study of the drawings and previous discussion.

Other aspects, objects and advantages of this invention can be obtained from a study of the drawings, the disclosure and appended claims.

I claim:

1. A fluid control system, comprising:

a reservoir;

a pump connected to said reservoir;

a first fluid operated jack having rod and head ends connected to said pump and adapted to deliver a first signal in response to a pressure within said jack being greater than a preselected magnitude;

a controlling valve having a first and second passageways, said first passageway being connected to and between said reservoir and one of the ends of said first jack, said second passageway being connected to and between said pump and the other end of said first jack, said controlling valve being movable between a first position at which said first and second passageways are blocked, a second position at which said first passageway is open to said reservoir and one end of said first jack and said second passageway is open to said pump and the other end of said first jack, and a third position at which said first passageway is open to said pump and said one end of said first jack and said second passageway is open to said reservoir and the other end of said first jack, said controlling valve enabling flow from either jack end to be connected to reservoir through said first or second controlling valve passageway when said controlling valve is in the second or third position;

a first selecting valve having a first passageway, said first selecting valve first passageway being connected to and between said controlling valve first passageway and said first jack, said first selecting valve being movable between a first position at which said first selecting valve first passageway is blocked and a second position at which said first selecting valve first passageway is open to said controlling valve first passageway and said first jack;

a first relief valve having a passageway and a signal port, said first relief valve passageway being connected to said jack and said controlling valve first passageway in parallel with said selecting valve, said first relief valve being movable between a first position at which said first relief valve passageway is blocked and a second position at which said first relief valve passageway is open to said jack and said controlling valve first passageway, said signal port being connected to said jack and being adapted to receive said first signal, said first relief valve being movable from said first position to said second position in response to receiving said first signal;

a bypass valve having a passageway, said bypass valve passageway being connected to and between said first selecting valve first passageway and said reservoir and in parallel with said controlling valve, said bypass valve being movable from a first position, at which said bypass valve passageway is open to said first selecting valve first passageway and said reservoir, to a second position, at which said bypass valve passageway is blocked;

means for generating a pilot signal; and means for directing said pilot signal to both of said controlling and bypass valves and moving said controlling valve from said first position to said second position and said bypass valve from said first position to said second position.

2. A fluid control system, as set forth in claim 1, wherein said first selecting valve has a second passageway which is connected to and between the controlling valve second passageway and the first jack, said first selector valve second passageway being blocked at the first position of said first selecting valve and being open to the controlling valve second passageway and said first jack at the second position of the first selecting valve;

a first conduit connecting said first passageway of the controlling valve to said first passageway of the first selecting valve; and a second conduit connecting said controlling valve second passageway to said selector valve second passageway, said first relief valve having an inlet and an outlet, said first relief valve inlet being connected to said first jack and said first relief valve outlet being connected to said first conduit, said first relief valve passageway connecting the first relief valve inlet to the first relief valve outlet at the second position of said first relief valve.

3. A fluid control system, as set forth in claim 2, wherein said selector valve first passageway being connected to one of the rod and head ends of said first jack and said selector valve second passageway being connected to the other of the rod and head ends of said first jack, said first relief valve inlet being connected to said one of the rod and head ends; and said first signal being delivered from said one of the rod and head ends of the first jack.

4. A fluid control system, as set forth in claim 3, including:

a second relief valve having a passageway and a signal port, said second relief valve passageway having an inlet and an outlet and being connected at the inlet of the second relief valve to the other of the rod and head ends of said first jack and at the outlet of said second relief valve to said second conduit, said second relief valve being movable between a first position at which the second relief valve passageway is blocked and a second position at which the second relief valve passageway is open to the said other of the rod and head ends of said first jack and said second conduit, said other rod and head ends of said first jack being adapted to deliver a second signal in response to a presssure within the said other rod and head ends of said first jack being greater than a preselected magnitude, said signal port of the second relief valve being connected to said other rod and head ends of said first jack and being adapted to receive said second signal, said second relief valve being movable from said first position toward said second position in response to receiving said second signal.

5. A fluid control system, as set forth in claim 2, wherein said bypass valve has an inlet and an outlet, said bypass valve inlet being connected to said first conduit and said bypass valve outlet being connected to said reservoir, said bypass valve passageway connecting the bypass valve inlet to the bypass valve outlet at the first position of the bypass valve.

6. A fluid control system, as set forth in claim 1, wherein said control and bypass valves each have a pilot port, said generating means includes a pilot pump, and said directing means includes:

a pilot valve having a passageway, an inlet and an outlet, said pilot valve inlet being connected to said pump and said pilot valve outlet being connected to the pilot port of each of the bypass and controlling valves, said pilot valve being manually movable between a first position at which said pilot valve passageway is blocked and a second position at which said pilot valve passageway is open to said pilot pump and said pilot ports, said bypass and controlling valves each being movable from their first positions, respectively, toward their second positions respectively, in response to movement of the pilot valve from the first position to the second position.

7. The fluid control system, as set forth in claim 6, wherein said bypass and controlling valves each have a spring, said bypass valve spring biasing the bypass valve toward the first position and said controlling valve spring biasing said controlling valve toward the first position.

8. A fluid control system, as set forth in claim 1, including:

a spring connected to said first selecting valve and biasing said first selecting valve from the second position toward the first position;

means for delivering a control signal to said first selecting valve; and means for receiving said delivered control signal and moving said first selecting valve from the first position to the second position.

9. A fluid control system, as set forth in claim 8, wherein said delivering means includes:

a source of electrical power;

a first switch connected to said source of electrical power, and wherein said means for receiving includes:

a first solenoid mounted on said first selecting valve and being connected to said first switch, said first switch being movable between an open position at which said power source is blocked from said first solenoid and a closed position at which said power source is connected to said first solenoid, said first solenoid being adapted to move said first selecting valve to said second position in response to said first switch being moved to the closed position.

10. A fluid control system, comprising:

a reservoir;

a pump connected to said reservoir;

a work implement;

a first fluid operated jack having rod and head ends and being mounted on said implement, said first fluid operated jack being connected to said pump, one of the rod and head ends of said first jack being adapted to deliver a first signal in response to pressure within said one of the head ends being greater than a preselected magnitude;

a controlling valve having first and second passageways and being connected to and between said pump, said reservoir, and said jack, said controlling valve being movable between a first position at which said first and second passageways are blocked, a second position at which one of said first and second passageways is open to said pump and one of the rod and head ends of said first jack and the other of said first and second passageways is open to the other of said rod and head ends of said first jack and said reservoir, and a third position at which the other of said first and second passageways is open to said pump and the other jack end and said one of the first and second passageways is open to said one jack end and said reservoir, said controlling valve enabling flow from either jack end to be connected to reservoir through said first or second controlling valve passageway when said controlling valve is in the second or third position;

a first selecting valve having first and second passageways and being connected to and between the controlling valve and the first jack, said first selecting valve being movable between a first position at which said first selecting valve first and second passageways are blocked, and a second position at which said first selecting valve first passageway is open to said one of the rod and head ends of said first jack and one of the control valve first and second passageways, and the first selecting valve and second passageway is open to said other of the rod and head ends of said first jack and the other of the controlling valve first and second passageways;

first means for receiving said first delivered signal and passing fluid flow from said one of the rod and head ends of said first jack, said fluid flow being passable by the first selecting valve to the other end of said first jack at the second position of the first selecting valve, and blocked from being passable to the other end of the first jack at the first position of said first selecting valve;

second means for passing fluid flow in parallel with said controlling valve from said first means to the reservoir in response to said controlling valve being at said first position, and for blocking fluid flow from passing in parallel from said first means to said reservoir in response to said controlling valve being at said second or third position.

11. A fluid control system, as set forth in claim 10, wherein said first selecting valve has first and second inlets and first and second outlets, and said first means includes:

a first relief valve having a signal port, a passageway, an inlet and an outlet, said first relief valve outlet being connected to the first inlet of the first selecting valve and said first relief valve inlet being connected to the head end of said first jack, said first relief valve being movable between a first position at which the first relief valve passageway is blocked and a second position at which said first relief valve passageway is open to the head end of said first jack and the selector valve first inlet, said first relief valve signal port being connected to the head end of said first jack and being adapted to receive said first signal, said first relief valve being movable from the first position toward the second position in response to receiving said first signal.

12. A fluid control system, as set forth in claim 11, wherein said rod end is adapted to deliver a second signal in response to pressure within said rod end being greater than a preselected magnitude, including:

a second relief valve having a passageway and a signal port, said second relief valve having an inlet and an outlet and being connected at the outlet of the second relief valve to the second inlet of said first selecting valve and being connected at the inlet of the second relief valve to the rod end of said first jack, said second relief valve being movable between a first position at which said second relief valve passageway is blocked and a second position at which said second relief valve passageway is open to the rod end of said first jack and the second inlet of said first selecting valve, said second relief valve signal port being connected to the rod end of said first jack and adapted to receive said second signal, said second relief valve being movable from said first position to said second position in response to receiving said second signal.

13. A fluid control system, as set forth in claim 12, wherein the rod end of said first jack is in communication with the head end of said first jack at the second position of the second relief valve and the second position of the first selecting valve.

14. A fluid control system, as set forth in claim 10, wherein the controlling valve has first and second inlets and first and second outlets, and said second means includes:

a bypass valve having a passageway, an inlet and an outlet and being connected at said bypass valve outlet to the reservoir and at said bypass valve inlet to the first outlet of the controlling valve, said bypass valve being movable between a first position at which the bypass valve passageway is open to the reservoir and the first outlet of the controlling valve, and a second position at which the bypass valve passageway blocked, said bypass valve being movable from the first position to the second position in response to movement of the controlling valve from the first position to the second or third position.

15. A fluid control system, as set forth in claim 14, wherein said bypass and controlling valves each have a pilot port, including:

a pilot pump;

a first pilot valve having a pair of passageways and being connected to the pilot pump, the reservoir, and the pilot ports of the bypass and controlling valves, said first pilot valve being movable between a first position at which one of the pilot valve passageways is open to the reservoir and the pilot ports of the bypass and controlling valves, and a second position at which the other first pilot valve passageway is open to the pilot pump and the pilot ports of the bypass and controlling valves; and each of said bypass and controlling valves being movable from their first respective positions to their second respective positions in response to movement of the first pilot valve from the first position to the second position.

16. A fluid control system, as set forth in claim 14, including:

a bypass valve spring connected to said bypass valve, said bypass valve spring biasing said bypass valve toward the first position; and a controlling valve spring connected to said controlling valve, said controlling valve spring biasing the controlling valve toward the first position.

17. A work vehicle, comprising:

a frame;

a work implement mounted on said frame;

a reservoir mounted on said frame;

a pump mounted on said frame and connected to said reservoir;

a first fluid operated jack having head and rod ends and being mounted on said work implement, one of the rod and head ends of said first jack being adapted to deliver a first signal in response to pressure within said one of the rod and head ends being at a pressure greater than a preselected magnitude;

a controlling valve having first and second passageways and being mounted on said frame, said controlling valve having first and second inlets and first and second outlets, said first inlet being connected to said reservoir and said second inlet being connected to said pump, said controlling valve being movable between a first position at which said first and second passageways are blocked, a second position at which said first passageway is open to said first inlet and said first outlet and said second passageway is open to said second inlet and said second outlet, and a third position at which said first passageway is open to said second inlet and said first outlet and said second passageway is open to said first inlet and said second outlet, said controlling valve enabling flow from either jack end to be connected to reservoir through said first or second controlling valve passageway when said controlling valve is in the second or third position;

a first selecting valve having first and second passageways and being mounted on said work implement, said first selecting valve having first and second inlets and first and second outlets, said controlling valve first outlet being connected to the first inlet of said first selecting valve and said controlling valve second outlet being connected to the second inlet of said first selecting valve, said selecting valve first outlet being connected to one of the rod and head ends of said first jack and said selecting valve second outlet being connected to the other of the rod and head ends of said first jack, said first selecting valve being movable between a first position at which the selector valve first and second passageways are blocked and a second position at which the first passageway is open to the selector valve first inlet and selector valve first outlet and the selector valve second passageway is open to the selector valve second inlet and selector valve second outlet;

a first relief valve having a passageway and a signal port and being mounted on said work implement, said first relief valve having an inlet and an outlet and being connected at the inlet to said one of the head and rod ends of said first jack and at the outlet to the first inlet of the first selecting valve, said signal port being connected to said one of the head and rod ends of said first jack, and adapted to receive said first signal, said first relief valve being movable between a first position at which said first relief valve passageway is blocked and a second position at which said first relief valve passageway is open to the inlet and outlet of said first relief valve, said first relief valve being movable from said first position to said second position in response to receiving said first delivered signal; and a bypass valve having a passageway and being mounted on the frame, said bypass valve having an inlet and an outlet and being connected at the inlet thereof to the first outlet of the controlling valve and at the outlet thereof to the reservoir, said bypass valve being movable between a first position at which the passageway thereof is open to the first outlet of the controlling valve and the reervoir, and a second position at which the passageway thereof is blocked a source of pressurized pilot fluid flow; and means for selectively directing said pilot fluid flow to both of said controlling and bypass valves and moving said controlling valve from said first position to said second position and said bypass valve from said first position to said second position.

18. A work vehicle, as set forth in claim 17, wherein the first selecting valve and the first relief valve connect the head end of said first jack to the rod end of said first jack at the second position of the first selector valve and the second position of the first relief valve.

* * * * *